US005224321A

United States Patent [19]

Fearn

[11] Patent Number: 5,224,321

[45] Date of Patent: Jul. 6, 1993

[54] BUILDING FOUNDATION AND FLOOR ASSEMBLY

[76] Inventor: Richard N. Fearn, 1817 Ocean Surf Place, South Surrey, British Columbia, Canada, V4A 4P1

[21] Appl. No.: 913,660

[22] Filed: Jul. 16, 1992

Related U.S. Application Data

[63] Continuation-in-part of Ser. No. 662,180, Feb. 28, 1991, abandoned, which is a continuation-in-part of Ser. No. 483,398, Feb. 22, 1990, abandoned.

[51] Int. Cl.[5] ..... E04C 1/35

[52] U.S. Cl. ..... 52/742; 52/292; 52/250; 52/743

[58] Field of Search ..... 52/292-299, 52/250, 251, 252, 319, 741, 742, 743, 741.1

[56] References Cited

FOREIGN PATENT DOCUMENTS 838768 6/1976 Belgium .
2062998 7/1972 Fed. Rep. of Germany .
2345173 3/1975 Fed. Rep. of Germany .
2849300 5/1980 Fed. Rep. of Germany .
2271356 12/1975 France .
2531470 2/1984 France .
2610339 8/1988 France .
949352 2/1964 United Kingdom .

*Primary Examiner*—Richard E. Chilcot, Jr.
*Attorney, Agent, or Firm*—Bull, Housser & Tupper

[57] ABSTRACT

The invention reduces considerably on-site labor costs for installing a foundation and a building floor. Accuracy is improved by pre-fabricating a floor assembly prior to installation on site. The invention includes placing a plurality of temporary supports on the site surface, accurately locating the floor assembly on the supports, and providing a space between the floor assembly and the surface. Forms are located on the surface generally below the floor assembly. Concrete is poured to occupy space between at least the form, the surface and a portion of the floor assembly so that, after the concrete is set, the supports are removed and the floor assembly is supported by the concrete. The floor assembly comprises upper and lower skins, with perimeter webs connecting the skins together adjacent peripheries of the skins to form a plenum chamber between the skins and the webs. Services and air can be supplied from the plenum chamber.

59 Claims, 6 Drawing Sheets

BUILDING FOUNDATION AND FLOOR ASSEMBLY

CROSS REFERENCE TO RELATED APPLICATIONS

This is a Continuation-in-Part application of my copending application Ser. No. 07/662,180, filed Feb. 28, 1991, which is now abandoned which in turn is a Continuation-in-Part of my application Ser. No. 07/483,398, filed Feb. 22, 1990, which is now abandoned.

BACKGROUND OF THE INVENTION

The invention relates to a building foundation and floor assembly, and method of installation thereof, in particular for use in residential house construction.

Foundations for houses are usually constructed using temporary concrete forms installed on load bearing earth and extending around a perimeter of the building. Flowable foundation material, such as concrete, is poured into spaces between the forms and allowed to harden, after which the temporary forms are manually removed.

This method of foundation construction incurs many problems, particularly relating to the uneven ground conditions which require considerable preparation by on-side labour. Height and location of the forms must be controlled accurately, both with respect to horizontal and vertical locations. When constructing in inclement weather conditions, such as heavy rain, snow or freezing conditions, difficulties of achieving dimensional accuracy are compounded. Furthermore, when the foundations have been poured, much of the temporary form work cannot be reused, resulting in wastage of forming material.

In some circumstances, in particular with relatively high form work, hydraulic pressure of a column of poured concrete can cause lower portions of the forms to shift upwardly, called "form uplift". This can cause severe problems.

When a prior art foundation has hardened, the wooden structure of the building is secured to an upper surface of the concrete. Typically, this upper surface is relatively rough, and is not completely level, and thus when horizontal wooden strips, called plates, are mounted on the upper surface, they are supported in an uneven manner, and subjected to twisting and bending. The plates are usually secured to the concrete by vertical threaded rods or sheet metal strips set in the concrete before the concrete is cured. The plates are secured to the rods by drilling holes in the plates to accept the rods, and securing the plates to the rods with nuts. Alternatively, the plates can be connected to the sheet metal strips by bending the strips to embrace the plates. Either method of securing the plates to the concrete is relatively inaccurate and subject to error, which has to be corrected at some other stage in construction.

Furthermore, when the floor joists and sub-floor have been installed a master carpenter is required to layout on the sub-floor the positions of interior and exterior walls, doors, windows etc. This is time consuming, and, even when care is taken, is subject to error which results in time consuming corrections later on in the building process.

Many inventions have been developed in attempts to reduce some of the above problems. For example, U.S. Pat. No. 4,711,058 (Patton) discloses a permanent concrete form comprising a metallic sheet permanently connected to an insulated barrier. While this reduces form work wastage, excessive on-site labour and problems of achieving dimensional accuracy remain. U.S. Pat. Nos. 3,673,750 (Bokvist el al) and 3,956,859 (Eingestrom) discloses heat and moisture insulating blocks placed around the perimeter of a foundation prior to pouring concrete. Excessive on-site labour, high foundation material costs and difficulty in maintaining accuracy still remain. U.S. Pat. No. 4,799,348 (Brami et al) discloses insulating a rigid slab for carrying a building but this also requires excessive on-site labour for site preparation, installation of recoverable forms and the need for accurate location of same. U.S. Pat. No. 4,689,926 (MacDonald) discloses a method of providing an insulating structure beneath a building or platform, as opposed to a true foundation. In this method the building is initially supported above a shell of resilient plastic material to define a space between the building and the shell, which space is substantially entirely filled with insulating foam. This is costly and would appear to be appropriate only for small buildings, such as mobile homes.

In the inventor's opinion, many of the inventions relating to building foundations disclosed in the patents above do not provide large reductions in on-site labour, nor reduce the necessity for accurate location of forms or placement of foundation material. Furthermore, none of the patents above disclose a means for eliminating the costly and time consuming layout necessary to mark a sub-floor with locations of exterior and interior walls as previously described.

SUMMARY OF THE INVENTION

The invention reduces the difficulty and disadvantages of the prior art by providing a method and apparatus which reduces considerably on-site labour, and removes the necessity of accurate location of temporary form work prior to pouring foundations. The invention permits pre-fabrication of floor assemblies which can be accurately pre-fabricated in a factory, using accurate and fast production tooling and semi-automatic or automatic assembly processes. The floor assemblies are thus produced to very close dimensional tolerances which are very difficult to attain on normal building sites. The floor assemblies are made in a size which can be transported on conventional flat bed trucks to a building site, after which they can be accurately installed with minimal on-site skilled labour requirements. Furthermore, the time consuming layout of the sub-floor to define positions of exterior and interior walls, doors etc. can be carried out in the factory, thus reducing on-site labour costs and considerably increasing accuracy.

The invention also permits use of simple, relatively low cost concrete form work which can be easily installed on the site with relatively wide dimensional tolerances. Furthermore, in the preferred embodiment, the low cost and simple form work can be arranged in such a manner that relatively low volumes of concrete are required to produce footings, when compared with other prior art foundations. Thus, less form work is required, with corresponding less concrete, and less time required in pouring the concrete, resulting in considerable savings in material and labour costs. It has been found that site preparation can be reduced considerably and a highly accurately located and installed floor assembly at first floor level can be installed on-site in considerably less time, and with a higher accuracy than with prior art methods.

Some embodiments of the invention require that the site be relatively level and smooth so as to reduce difficulties that would otherwise occur with excessive variations from a horizontal plane for portions of the site requiring foundations. However, one embodiment of the invention has a relatively wide tolerance to variations in site levelness and smoothness, and thus permits a building to be installed on a site without extensive site preparation work, thus further reducing on-site labour costs from some other embodiments of the invention.

A method according to the invention for installing a floor assembly and building foundation on a site surface comprises the following steps:

placing a plurality of supports on the surface, placing a floor assembly on the supports to provide a space between the floor assembly and the surface, locating form means below some peripheral portions of the floor assembly, supplying a flowable and settable foundation material to occupy at least a portion of a space defined in part by the form means and the surface, and to be located below the peripheral portions of the floor assembly, so that when the foundation material has set, the floor assembly is supported on the foundation material.

Preferably, the method further includes: connecting a sub-wall to the floor assembly so as to extend downwardly from the floor assembly, the sub-wall having a sub-wall base spaced above the surface, locating the form means with respect to the sub-wall, supplying the foundation material to occupy a portion of the space between the sub-wall base, the form means and the surface.

For use in a building requiring more than one floor assembly, the method further includes:

placing a plurality of floor assemblies on the supports to provide respective spaces between the floor assemblies and the surface, interconnecting the adjacent floor assemblies together along adjacent joining portions thereof to form an assembled floor of a building, locating the form means on the surface to surround an overall periphery of the assembled floor, so that when the foundation material is set, the assembled floor is supported along the overall periphery thereof.

The supports are removed after the foundation material is set and can be used again elsewhere, and in some instances the form means can be permanently left on the foundations. Preferably, portions of service conduits have been previously located to extend through the floor assemblies as installed, and can be interconnected after assembly of the floor assemblies.

A pre-fabricated floor and foundation installation according to the invention comprises a first floor assembly having a first upper skin and a first lower skin, outer webs and trim webs connecting the skins together adjacent peripheries of the skins to form a plenum chamber between the skins and the webs. Foundation material is located on a site surface, and closely conforms to a lower portion of the floor assemblies to support the floor assembly above the surface, and to resist lateral forces on the floor assembly. Thermal insulation cooperates with the lower skin so as to assist in insulating the plenum chamber. Preferably, at least one web has an opening and a service conduit is located between the skins and passes through the opening in the web. The conduit has an end located adjacent a portion of the periphery of the floor assembly. A plurality of inner webs extend between the ends of the assembly to divide the plenum chamber into plenum chamber portions, the inner webs having openings to interconnect the plenum chamber portions. The service conduit extends through at least some of the openings in the inner webs. Preferably, the lower portion of the assembly includes a sub-wall having a sub-wall base, the sub-wall extending downwardly from the floor assembly. Also, the foundation material closely conforms to the sub-wall base so as to support the floor assembly thereon and to resist lateral forces on the foundation.

A building foundation apparatus according to the invention comprises a support means having upper and lower portions, the lower portion having laterally spaced apart lower edge portions, and the upper portion being connectable to a floor assembly. The apparatus also includes a flexible form means connected to the lower portion of the support means to form a curved sheet of flexible form means extending therebetween and being adapted to receive and hold a flowable and settable foundation material.

A detailed disclosure following, relating to drawings, describes a preferred method and apparatus according to the invention, which is capable of expression in structure other than that particularly described and illustrated.

DETAILED DISCLOSURE

Figure 1:
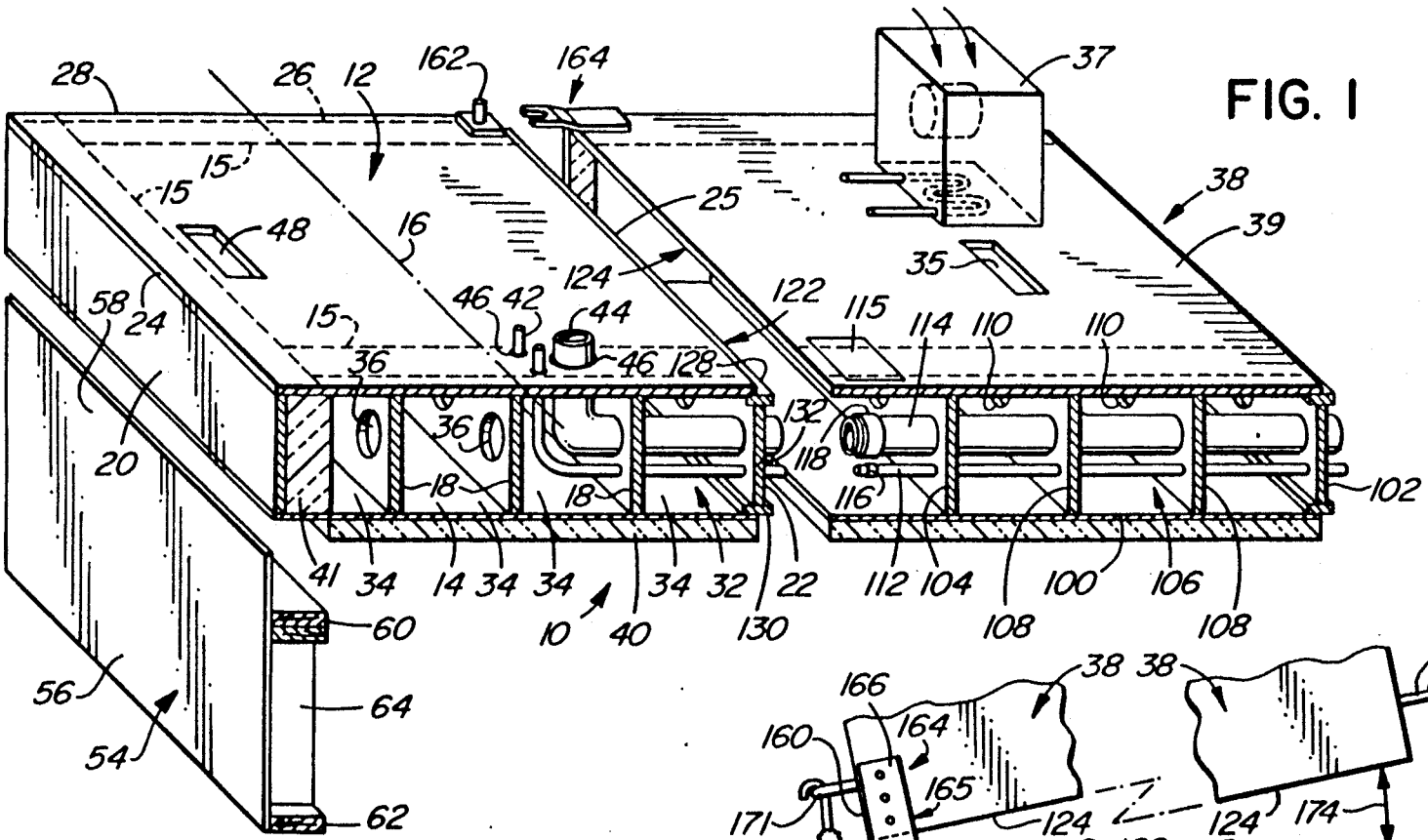
FIG. 1 is a simplified, fragmented, partially exploded isometric view of two prefabricated floor assemblies according to the invention, a sub-wall according to a first embodiment of the invention shown closely adjacent one of the floor assemblies, and air handling equipment shown prior to installation on the other floor assembly.
Figure 2:
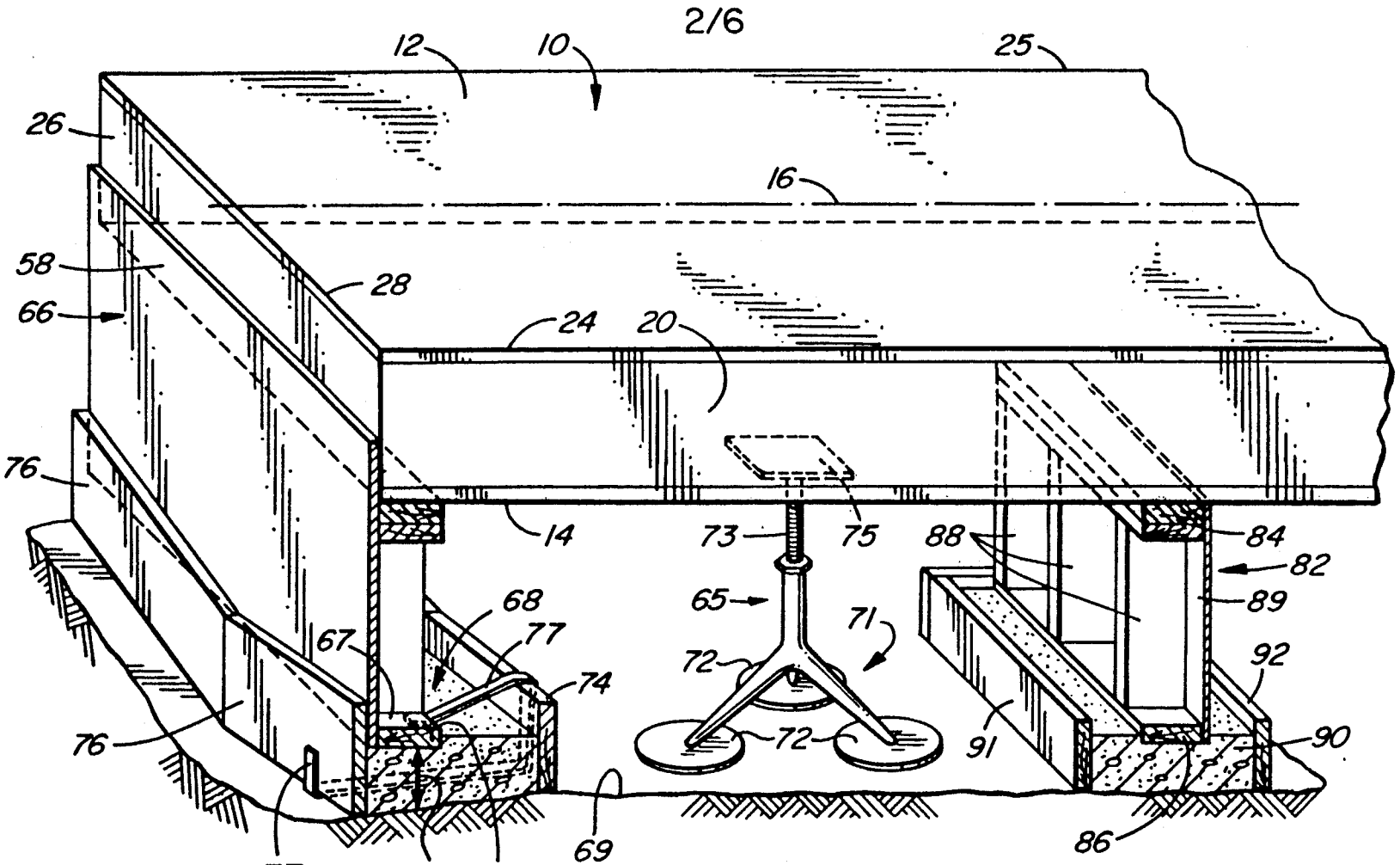
FIG. 2 is a simplified, fragmented isometric view of a portion of one floor assembly installed, the floor assembly being temporarily supported on an adjustable temporary support, with portions of exterior and interior foundation form means, footings, and sub-walls of the first embodiment of the invention installed.
Figure 3:
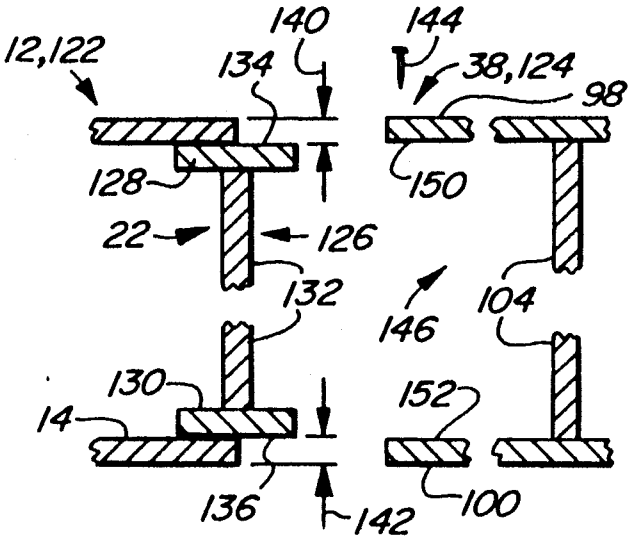
FIG. 3 is a fragmented detail diagram showing joining portions of two adjacent skins.
Figure 8:
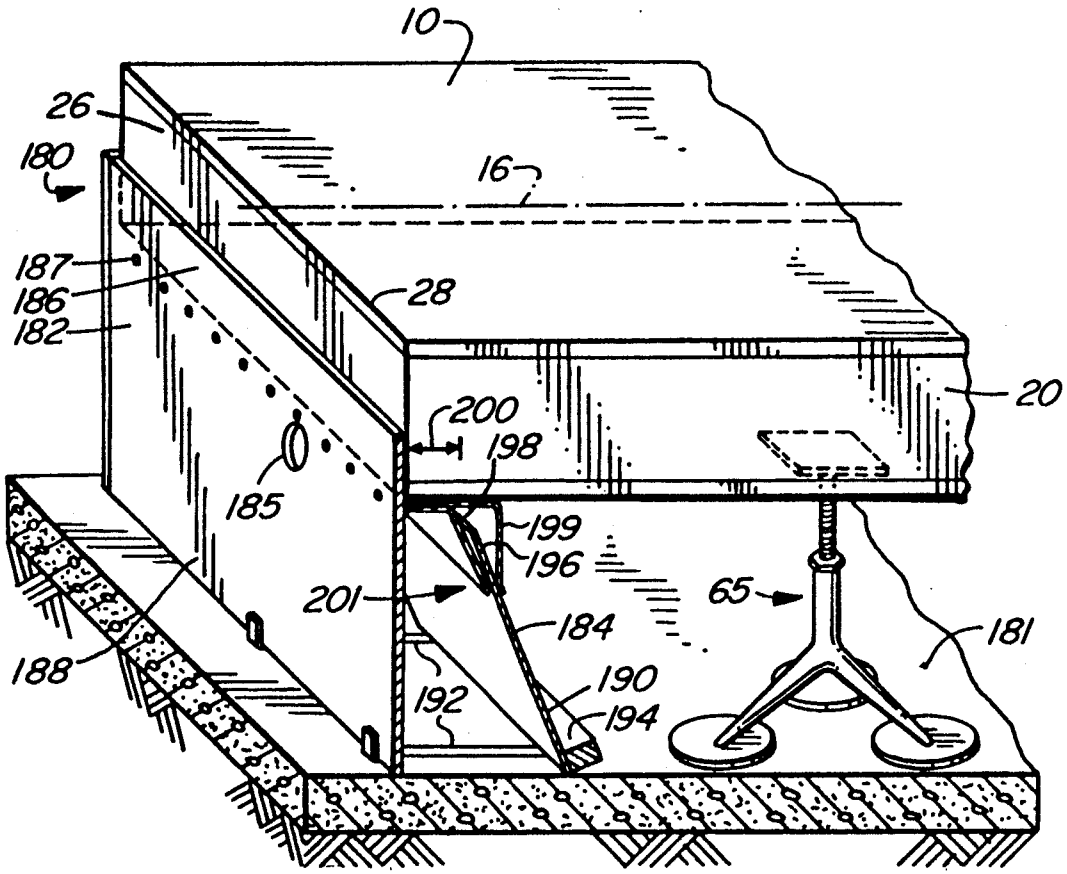
FIG. 8 is a simplified, fragmented perspective generally similar to FIG. 2, showing the floor assembly temporarily supported, and a second embodiment of foundation form means installed prior to pouring concrete.

FIGS. 1 through 3

For buildings of normal size, a plurality of prefabricated floor assemblies are required, the floor assemblies being generally similar, and differing only in specific features, such as dimensions, services, etc. dependant on the location of the particular floor assembly within the building.

In FIG. 1, a pre-fabricated first floor assembly 10 has a first upper skin 12 and a first lower skin 14, the skins being rectangular, and having generally equal dimensions so that peripheries of the skins can be aligned with each other within respective vertical planes as shown.

The upper skin 12 serves as a portion of a final subfloor of an assembled floor, and has layout markings 15, shown in broken outline, defining locations of exterior walls, interior walls, doors, windows etc. as is well known. These markings can be marked very accurately on the upper panel 12 in the factory, and thus can be closely controlled and eliminate the costly and time consuming layout normally occurring on-site.

The assembly 10 has a longitudinal axis 16, and a plurality of inner webs 18 disposed parallel to the axis 16 and interconnecting the upper and lower skins. peripheral outer webs 20 and 22 are parallel to the inner webs and extend along parallel side edges 24 and 25 respectively of the upper skin 12, and interconnect aligned parallel edges of the lower skin 14. The side edges 24 and 25 are thus parallel to the axis 16 and provide longer sides of the rectangle, but in FIG. 1 are fragmented and shown relatively short. Peripheral trim webs 26, one only being shown in FIG. 1, extend along opposite shorter edges of the rectangle of the first skin, one shorter end edge 28 being shown. The peripheral webs are similarly connected to the edges of the upper and lower skins so as to define a generally hollow rectangular block with adjacent peripheries of the skins connected together to form a plenum chamber 32 between the skins and the webs. It can be seen that the plurality of inner webs 18 extending between the trim webs at the opposite ends of the assembly divide the plenum chamber 32 into a plurality of plenum chamber portions 34. The inner webs have a plurality of openings 36 for conduit clearance as will be described, and to interconnect the plenum chamber portions so that air can circulate between different portions of the skin.

Thermal insulation 40, such as a rigid expanded plastic or heat reflective coating, is connected to a lower surface of the lower skin 14 to cooperate therewith and to assist in insulating the plenum chamber. Similarly, thermal insulation 41 also extends along an inner face of the outer web 20 and other peripheral webs which define portions of eventual outer edges of the building. An air handler 37, such as a fan and heat exchanger, shown separated in FIG. 1, cooperates with an opening 35 in an upper skin 39 of a second floor assembly 38, so as to supply heated or cooled air to a similar plenum chamber within the assembly 38 for distribution into the assembly 10 and into other floor assemblies of the building. The heat exchanger can be a portion of a conventional heating system, or air conditioning system, or both, depending on the application. The upper skin 12 also has a heat register opening 48 communicating with the plenum chamber to receive heated air therefrom, and other heat register openings, not shown, can be provided to distribute heated or treated air within the building.

Service conduits such as supply water conduit 42, and waste water conduit 44, extend between the skins 12 and 14 and through at least some of the openings 36 of the inner webs 18 between the outer webs 22, and also through respective clearance openings 46 in the upper skin 12. It can be seen that the conduits 42 and 44 extend upwardly through the respective openings 46 in the upper skin 12 and can be connected to appropriate conduits when the building is completed, so as to supply water to, and return waste water from, various appliances within the building.

When the assemblies are transported to the site, or stored, usually with one on top of the other, spacer blocks, not shown, are provided to protect projecting upper ends of the conduits 42 and 44 extending from a lower floor assembly from damage due to an adjacent upper floor assembly resting on top of the lower floor assembly. The use of spacer blocks is well known, and also facilitates slinging of the floor assemblies for handling and later installation as is well known.

In the preferred embodiment, a sub-wall 54 eventually will extend along and downwardly from a portion of a periphery of the floor assembly 10, ie adjacent the outer web 20 of the side edge 24 to eventually form an outer foundation wall of the building. The sub-wall 54 includes a foundation wall sheathing 56 which can be preserved wood sheathing such as plywood, having an upper wall portion 58 which is securable to the outer web 20 using conventional fasteners. The sub-wall 54 also includes upper and lower plates 60 and 62, with a plurality of vertically extending, laterally spaced, studs 64 supporting the plates, one stud only being shown in FIG. 1.

Referring to FIG. 2, a temporary adjustable support 65 is supported on a site surface 69 to temporarily support a portion of weight of the floor assembly as will be described. The temporary support 65 has a tripod base portion 71 having three downwardly extending legs, with lower pads 72 provided at ends of each leg. A threaded shaft 73 is extendable and retractable of the tripod base portion, and carries an upper pad 75 at an upper end which engages the lower skin of the floor assembly.

In FIG. 2, for clarity of illustration, the sub-wall 54 of FIG. 1 is not shown connected to the edge 24 as it would be when completed. Instead, the peripheral trim web 26 is shown fitted with a similar sub-wall 66 which extends downwardly from adjacent the edge 28 of the skin. The sub-wall 66 has a lower plate 67 to provide a sub-wall base as before, which cooperates with an exterior foundation footing 68. Similar sub-walls, not shown, are provided adjacent outer edges of other floor assemblies to cooperate with respective exterior foundation footings.

In FIG. 2, the cooperation between the sub-wall 66 and the exterior foundation footing 68 is as follows. The foundation footing 68 is constructed on-site, following conventional methods, and thus contrasts with the prefabricated construction of the floor assembly and sub-walls as previously described. Thus, flowable foundation material, eg. concrete, is poured between a pair of forms, namely inner and outer forms 74 and 76, the forms being supported in vertical manner as shown resting on a prepared site surface 69. The forms are cut in lengths to approximately follow contours of the surface 69 to prevent excessive loss of concrete. Upper edges of the forms can be disposed relatively inaccurately when compared with conventional forms. The outer form 76 is secured to the sub-wall 66 so as to be generally co-planer therewith, that is adjacent surfaces of the outer form 76 and the sub-wall 66 are within the same generally vertical plane. The inner form means 74 is located by a metal strip 77 passing in a loop from the outer form means 76. The forms 74 and 76 are disposed below an outer periphery of the floor assembly and provide a sufficiently wide footing. Ground stakes, not shown, can be added as needed to provide additional support for the forms.

It can be seen that a lower surface of the lower plate 67, ie the sub-wall base, is spaced above the site surface 69 by a vertical spacing 78, which can vary considerably depending on the levelness of the site surface, location of the lower plate 67, and other factors as will be described. Preferably, to ensure full support of the plate 67, excess concrete is poured to ensure the cured concrete surface is above the lower surface of the plate 67 to produce a shoulder so in the concrete. This provides support for the plate against lateral force of the backfilled soil, thus eliminating the need for metal straps or rods as used in the prior art.

For most buildings, interior foundation walls are also required to provide intermediate support for relatively long joists extending between oppositely located foundation walls extending along outer peripheries of the building. Thus, one or more additional interior sub-walls, for example an interior sub-wall 82, would be located at a position remote from a periphery of the floor assembly to provide an interior foundation wall of the building. Similarly to the sub-walls 54 and 66, the interior sub-wall 82 has upper and lower plates 84 and 86 connected together by a plurality of vertically disposed, laterally spaced studs 88 and an interior foundation wall sheathing 89. An interior foundation footing 90 is similarly produced between spaced forms 91 and 92 in a similar manner to the foundation footing 68.

Referring again to FIG. 1, the second floor assembly 38 has the second upper skin 39 and a second lower skin 100, outer webs 102 and 104, and trim webs, not shown, interconnecting the skins together adjacent peripheries thereof as before to form a plenum chamber 106 between the skins and the webs. The second floor assembly 38 also includes a plurality of inner webs 108 extending between ends of the assembly to divide the plenum chamber into plenum chamber portions, the inner and outer webs having openings 110 to interconnect the plenum chamber portions.

Similarly to the first floor assembly 10, service conduits 112 and 114 extend through at least some of the openings 110 in the inner and outer webs, and have outer ends adjacent edges of the skins, some of which are also located beneath an access opening 115, which is normally kept closed by a complementary undesignated door. The outer ends of the service conduits 112 and 114 carry known couplings 116 and 118 which are accessible through the opening 115 when the floors are assembled, to permit the conduits 112 and 114 to be connected by the couplings 116 and 118 respectively to adjacent aligned end portions of the service conduits 42 and 44 of the first floor assembly. Clearly, each service conduit located between the skins may have at least one end located adjacent a portion of the periphery of the floor assembly, to permit coupling together of conduits, and to facilitate transportation and storage of the floor assemblies.

Referring to FIGS. 1 and 3, the first and second floor assemblies 10 and 38 have first and second joining portions 122 and 124 respectively, the joining portions being complementary to each other. The joining portion 122 of the first floor assembly has an I-beam shaped outer web 22, the I-beam having upper and lower horizontal flanges 128 and 130 respectively, which are interconnected by a vertical web 132. It can be seen that the flanges of the I-beam web 22 serves as a projection 126 for the joining portion of the first floor assembly. An upper surface 134 of the upper flange provides an upper male surface, and a lower surface 136 of the lower flange provides a lower male surface. The upper and lower male surfaces are critical and extend outwardly of the first upper and lower skins respectively with respect to the joining portion. The upper male surface 134 is spaced below an upper surface of the first upper skin 12 by an upper space 140, ie thickness of the skin 12. Similarly, the lower male surface 136 is spaced above a lower surface of the first lower skin 14 by a lower spacing 142, ie thickness of the skin 14. Usually, the upper skin 12 is thicker than the lower skin 14 because the skin 12 serves as a sub-floor, and thus the upper spacing is greater than the lower spacing. The lower skin 14 stiffens the floor assembly, and seals and insulates the plenum chamber 32 for air distribution as described.

The joining portion 124 of the second floor assembly 38 is a female portion and has a recess 146 to receive the I-beam or projection of the first floor assembly. The recess 146 is defined in part by critical surfaces of the upper and lower skins 98 and 110, namely an upper female surface 150, and a lower female surface 152. The upper female surface is a lower surface of the upper skin 39 and thus is spaced below an upper surface of the upper skin by the upper spacing 140, assuming the two upper skins 12 and 39 have the same thickness. Similarly, the lower female surface is an upper surface of the lower skin 100 and thus is spaced above a lower surface of the lower skin by the said lower spacing 142, assuming both lower skins 14 and 100 are of the same thickness.

When the floor assemblies are connected together, the upper and lower skins of the second floor assembly are closely adjacent the upper and lower flanges 128 and 130 of the I-beam, and can be secured thereto by fastener means, e.g. screws 144, passing through at least an edge portion of the upper skin 98 of second floor assembly to connect to the projection or upper flange of the I-beam.

As seen in FIG. 1, the outer web 102 of the second assembly 38 is I-beam shaped similarly to the outer web 22 of the first assembly 10. Thus, the assembly 38 has a recess along one joining portion, and a complementary projection along the opposite joining portion, and thus can cooperate with a third similar assembly not shown, to provide an assembled floor. Also, to facilitate joining between the two assemblies, complementary male and female guide means 162 and 164 are fitted to adjacent corners of the assemblies 10 and 38. These guide means require accurate installation, which is preferably carried out off-site in the controlled environment of the assembly shop. Similarly to the conduits projecting from the skins, the guide means should be protected from damage during storage and transportation, as they are required to be very accurately located. Further description of the guide means is found with the reference to FIG. 6.

Referring again to FIG. 3, to facilitate initial engagement of the complementary surfaces of the projection 126 with the recess 146, preferably shallow tapers are provided on the complementary surfaces 134 and 150, and 136 and 152. This shallow tapering is sufficient to provide clearances adjacent outer edges of the surfaces of approximately 2 to 3 mms. (approximately one eighth of an inch) on each side, so that the surfaces can be brought smoothly together, thus reducing chances of grain splinters from interfering with complete engagement. Also, glue is preferably provided along the complementary surfaces prior to engagement, the glue serving not only to provide bonding when dried, but to provide a lubricant to enable smooth connection of the surfaces during assembly.

OPERATION

FIGS. 1 through 7

The foundation and floor assemblies are installed at a suitable building site as follows. The floor assemblies are transported to the site from a manufacturing or storage facility in the condition as shown in FIG. 1. Thus, the sub-walls are disassembled from the floor assemblies, and the portions of the conduits projecting from the upper surfaces of lower assemblies are protected from upper assemblies by suitable spacers. It is anticipated that a normal flat bed trailer with a truck crane could carry sufficient floor assemblies for one or two normal-sized houses, which are unloaded on the site by a crane. Typical weight of a floor assembly would be between approximately 700 and 1200 kgs. (approximately 1500 and 2500 lbs.), and thus a medium capacity truck crane is all that would be required.

The site surface 69 has been prepared minimally, by clearing organic overburden, so as to obtain a load bearing sub-strata upon which concrete can be poured. There is no requirement for accurate setting out of the foundation plan on the site, nor is there any requirement for excessive site levelling work due to the versatility of the present invention. Moderate variations in vertical height can be accommodated easily by suitable choice of heights of sub-walls and of footings. On a relatively steeply inclined slope, several different sub-walls of different heights could be used so as to be stepped to provide a series of staggered foundations if needed to follow the slope. Shallow slopes of up to 1 in 20 can be accommodated by using a constant sub-wall height with a tapering footing height. As stated previously, each sub-wall is pre-fabricated prior to delivery, and thus can be manufactured with dimensional tolerance standards far higher than normally obtainable with on-site labour.

Figure 4:
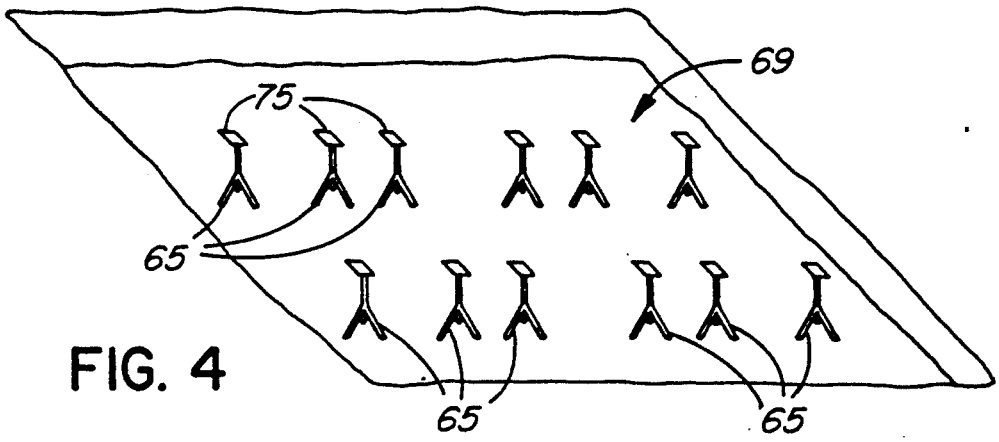
FIG. 4 is a diagram showing a building site after preparation, the site carrying several temporary supports to receive the floor assemblies.

Referring to FIG. 4, a plurality of the temporary adjustable supports 65 are set upon the surface 69, and disposed at locations as required to support each floor assembly with negligible deflection. Prior to setting the floor assemblies on the supports, the upper pads 75 of the supports are levelled, using builder's levels or other levelling systems. Each floor assembly, in turn, is supported by the crane and carefully and slowly lowered and set in a required location with respect to property lines etc., as the final location of the floor assembly clearly determines the final location of the building. Reference points can be established by use of taut strings located near the supports, thus defining locations of edges of the floor assemblies, so as to facilitate initial set up of the floor assemblies.

Figure 6:
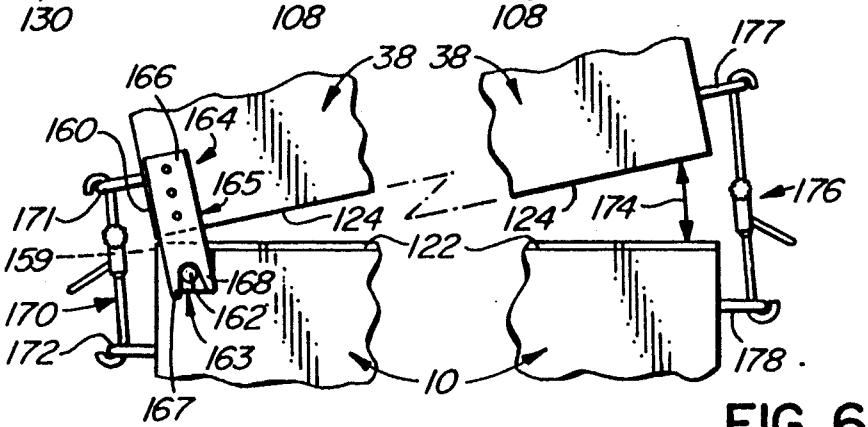
FIG. 6 is a fragmented top plan diagram showing the joining portions of the two adjacent skins with guide means to facilitate initial engagement of corner portions of the skins.
Figure 5:
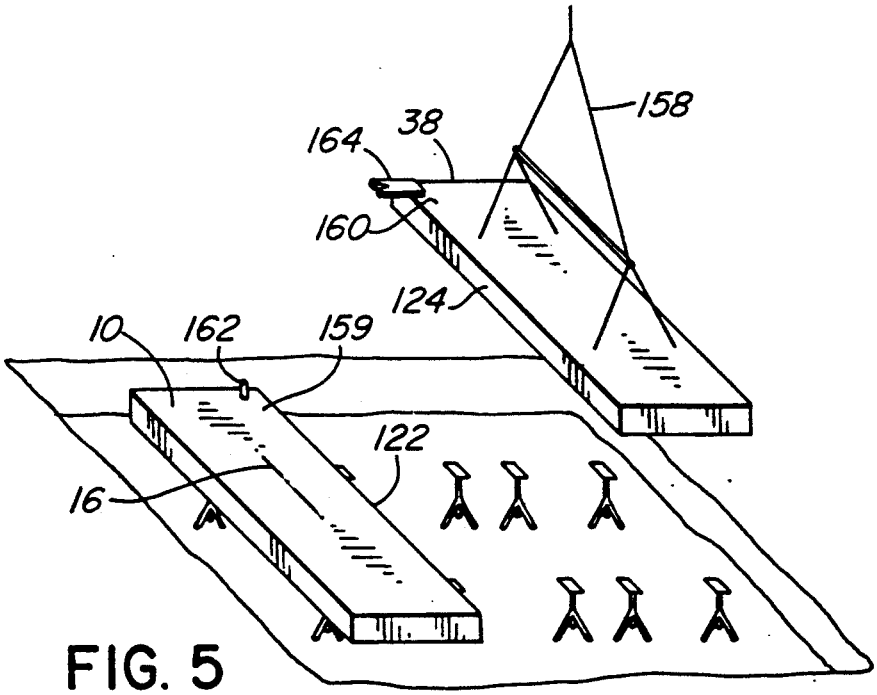
FIG. 5 is a view similar to FIG. 3, with one floor assembly temporarily supported, and a second floor assembly being lowered onto the supports prior to installation of sub-walls.

Referring to FIGS. 5 and 6, the assembly 10 is supported on some supports 65, and is levelled by final adjustment of the supports using the builder's levels, etc. An adjoining floor assembly, such as the floor assembly 38, is carried on a bridle 158 supported from the crane so as to be generally level. The assembly 35 is slowly lowered until a corner 160 of the assembly 35 is closely adjacent to a corner 159 of the assembly 10. In this position, the two floor assemblies are essentially co-planar, and essentially all of the weight of the floor assembly 35 is still carried by the bridle 158.

As previously described, to facilitate initial engagement of the corners of the two adjacent assemblies 10 and 38, the male and female guide means 162 and 164 at the adjacent Corners 159 and 160 of the assemblies 10 and 38 cooperate as follows. The male guide means is a plate carrying a pin 162 which is secured to extend essentially vertically upwardly from adjacent the Corner 159. The female guide means 164 is a recessed plate member 165 having a base portion 166 secured to an upper surface of the skin 58. The plate member 165 also has a V-shaped recess 163 defined by a pair of outwardly diverging edges of arm portions 167 and 168. The arm portions extend outwardly from the joining portion 124 of the assembly 38 towards the assembly 10, and have outer ends spaced apart at a distance several times greater than the diameter of the pin 162. An inner end of the recess 163 is slightly greater than the diameter of the pin to provide a secure and accurate seating therein. Preferably, the arm portions extend slightly upwardly out of a plane of the upper surface of the skin to resist tendency of the arm portions to gouge the surface of the skin 10.

To facilitate guiding the assemblies together, the two corners 159 and 160 can be drawn closely into engagement with each other by a simple winching system as follows. A first winching system 170, such as a hand-operated ratchet "come-along", extends between anchors 171 and 172 temporarily connected to end portions of the two floor assemblies 38 and 10. When the winching system 170 is operated, the corner 160 can be carefully moved closer towards the final position with respect to the corner 159, the movement being guided by the guide means 162 and 164. Thus the female surfaces of the upper and lower skins 98 and 100 (FIG. 3) adjacent the corner 160 engage the upper and lower flanges 128 and 130 (FIG. 3) of the joining edge of corner 159 of the first floor assembly. Care should be taken to ensure that adjacent edges at the corner are aligned, and, due to close manufacturing tolerances of the assemblies, it should be possible to obtain a snug fit between the two corners only of the adjacent floor assemblies.

Thus, in summary, it can be seen in FIG. 6 that when initially aligning the assemblies, the pin 162 is relatively easily received between the two arms of the guide means 164, and as the assemblies are brought closer together, the pin moves towards the inner portion of the recess until it is received within the inner end, at which position the complementary joining portions of the corners of the skin are fully engaged. At this point, there will be a triangular-shaped gap defined by oppositely facing joining portions 122 and 124 of the two skins which are disposed as an angle 174. A second winching system 176 can be connected to anchors 177 and 178 temporarily connected to opposite end faces of the two assemblies 38 and 10. The second winching system is actuated to draw oppositely facing joining portions 124 and 122 into engagement with each other, thus reducing the angle 174 to zero. If the second assembly 138 sags under its own weight, some portions of the assembly 38 will require raising a short distance to facilitate smooth engagement with the first assembly 10. When the floor assemblies have been levelled and connected together using the screws 144, the service conduits can be similarly connected, using the appropriate couplings which can be accessed through the access opening 115. Thus, the method includes interconnecting the ends of adjacent service conduits together to provide an interconnected service conduit extending between the interconnected floor assemblies. This requires providing an access opening adjacent a joining portion having a recess, which permits an installer to reach into the recess, align appropriate service conduits, and couple them together with the respective coupling. The access opening is closed by the appropriate door when no longer in use.

Referring to FIGS. 1 and 2, when all the floor assemblies are connected together to form the assembled floor, the sub-walls are installed to extend around the periphery of the assembled floor so that they are located directly beneath the outer periphery of an appropriate floor assembly, and are spaced above the surface of the site by a minimum space 78 that provides a sufficient depth of concrete for required strength, that is typically about 7–15 cms. (3 or 6 inches). As stated previously, if the site is sloping, sub-walls of varying heights can be installed, so as to provide a series of stepped sub-walls. At all times, minimum spacing between the sub-wall base and the surface should be between 3 and 6 inches. Sub-walls prefabricated in 15 cm (6 inch) increments are probably acceptable, requiring the footings to vary in depth between 3 and 12 inches.

Referring to FIG. 2, when the sub-wall 66 is installed, the respective outer form 76 can be nailed to an outer surface of the sub-wall, and additionally located with some earth stakes if needed. Thus, in contrast with prior art methods known to the inventor in which the building structure is located after, and with respect to, a previously prepared foundation structure, in the present invention the form means and resulting foundation structure are positioned with respect to the installed sub-wall extending downwardly from the previously positioned floor assembly. This is considered to be a major advantage, in that the floor assembly has been accurately located, and the sub-wall and foundation structure are then, in effect, built downwardly from an accurately located floor. This enables the foundation structure to accommodate terrain variations adjacent the periphery of the floor.

The inner form 74 can then be located inwardly of the outer form to provide a sufficient width of footings. Suitable metal straps 77 can be used to locate the inner form relative to the outer form and within a generally vertical plane as shown. It is seen that the outer form is automatically located flush against the outer surface of the sub-wall and thus, provides a flush finish to an outer wall of the footing when the outer form is removed.

Interior foundation walls remote from the outer periphery of the assembled floor are similarly established by securing the interior sub-wall 82 to the lower skin of the assembly in the required location, and then providing the pair of spaced interior forms 91 and 92 on either side in a manner similar to the peripheral forms.

At this stage, it can be seen that the method according to the invention is characterized by supporting a plurality of supports on the surface, and placing a floor assembly on the supports to provide a space between the floor assembly and the surface. The sub-wall is located to extend along a portion of the periphery of the floor assembly to form an outer foundation of the assembled floor. This is followed by locating form means on the surface with respect to the periphery of the floor assembly so as to straddle the sub-wall base and to be spaced below the floor assembly. A portion of the outer form means is connected to the sub-wall to control location of the outer form means. It can be seen that an inner portion of the floor assembly and corresponding portions of the site surface spaced therebeneath are without form means, and that a crawl space exists between the inner portion of the floor assembly and the corresponding site surface spaced therebeneath.

A supply of flowable and settable foundation material is now installed, for example conventional "ready-mix" concrete, which can be pumped to fill the space between the form means, the surface and sub-wall base as required. Clearly, there has to be sufficient volume of concrete within the form means to fully embrace the sub-wall base, ie a lower surface of the lower plate, to provide full support along a lower surface thereof. Preferably, there is sufficient concrete to fill the space somewhat above the lower surface of the sub-wall base, typically between 1 and 2 cms. extra (ie between one half inch and one inch extra), which augments securing of the lower plate in the concrete by providing at least the shoulder 80 on one side of the plate to resist movement of the plate laterally. Because the foundation material closely conforms to the sub-wall base, the resulting concrete shoulder 80 eliminates the prior art requirement for sheet metal strips set in the foundation material, or for vertical rods or other connecting means which are normally used to connect the lower plate to the foundation.

Figure 7:
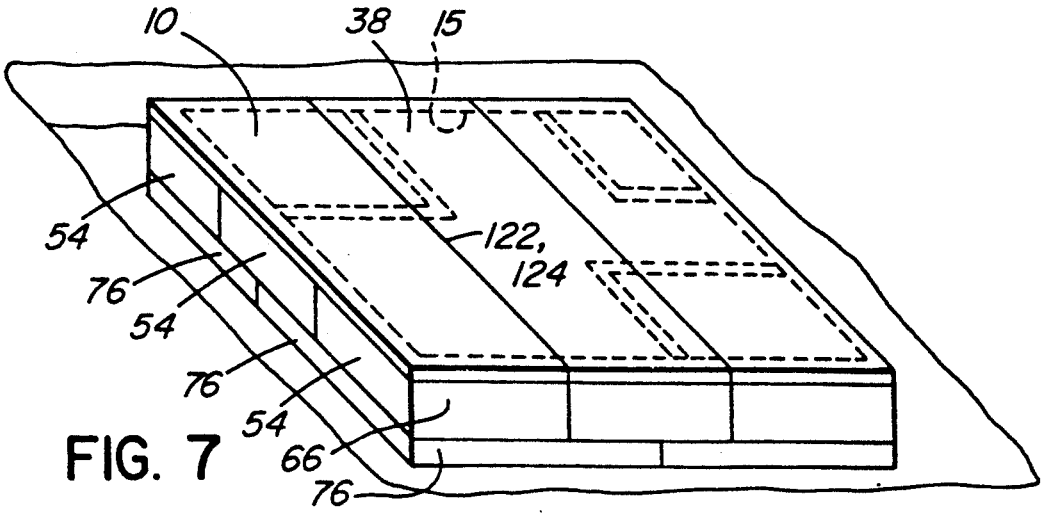
FIG. 7 is a view similar to FIG. 3, showing three floor assemblies fully installed with sub-walls fitted, showing form means before removal.

When the concrete has set the temporary supports 65 can be lowered and removed, so that completed floor is then supported on the sub-walls and footings as shown in FIG. 7. Normal wall construction can then commence, using the accurately located markings 15 on the upper skins 12 and 19.

ALTENATIVES

The description above is assuming that two or more floor assemblies are required to produce a completed floor. Clearly, for a small building, or where manufacturing, transportation and lifting facilities are of sufficient capacity, a single floor assembly could be used to produce a complete floor for a single building, which would not require joining of two or more floor assemblies together. Thus, the sub-walls would extend completely around the single floor assembly and there would then be no requirement for connecting portions, as shown, and clearly many of the benefits of the invention would still result.

FIG. 8

The assemblies previously described disclose sub-walls of treated wood, which is not always acceptable because of local building code requirements, public acceptance etc. An alternative structure according to the invention can utilize concrete foundations which extend from the site surface to a lower surface of the lower skin of the floor assembly, thus eliminating the need for separate, prefabricated wooden sub-walls. This alternative requires considerably more concrete than the previously described embodiment, and also requires more forming material, but otherwise functions essentially equivalently.

A portion of the floor assembly is shown temporarily supported on one of several supports 65. An alternative foundation structure or form means according to the invention includes an outer form means 182, and an inner form means 184, the form means being located on a prepared site surface 181 as shown. The outer form means 182 has an upper portion 186 secured to an outer web 26 and a lower portion 188 adjacent the site surface. An edge of the lower portion should be fairly close, ie within 5–10 cm (about 2–4 inches) of the site surface to reduce loss of concrete. The upper portion 186 has at least one delivery opening 185, and a plurality of breather openings 187 located closely beneath a plane of the floor assembly. The inner form means 184 has a lower portion 190 located adjacent the site surface 181 and secured to the outer form means 182 by metal straps 192 lying along the site surface. The straps 192 tie the form means together to resist hydraulic pressure of concrete. A stiffener 194 is used to strengthen a lower edge of the form means 184 against hydraulic pressure of the poured concrete, the inner form means being a relatively thin piece of plywood.

The inner form means 184 has an upper portion 196 sandwiched between and connected to two thin metal plates 198 and 199 extending along a lower surface of the floor assembly to locate the upper portion 196 of the inner form means. The upper portions 186 and 196 of the form means are spaced apart by a spacing 200 to provide an adequately wide bearing surface of concrete wall to contact the floor assembly.

Thus, in summary, it can be seen that the method of the invention when using the alternative form means is characterized by the foundation material being located on the site surface and closely conforming to a lower portion of the floor assembly to support the floor assembly above the surface. The method further includes locating the outer form means 182 to extend from a portion of the periphery of the floor assembly to the site surface, and locating the inner form means 184 to extend between the floor assembly and the surface. The inner form means is disposed generally adjacent to, but spaced inwardly of, the outer form means so as to provide a foundation space 201 defined by the inner and outer form means, and adjacent portions of the floor assembly 10 and the site surface 181. It is also seen that the outer form means is located by securing with fastening means to an adjacent periphery of the floor assembly, and the inner form means is located by securing with fastener means to positions disposed inwardly of the adjacent periphery of the floor assembly.

In operation, the alternative form means 180 is used very similarly to the previously described embodiment, with the exception that the outer form means 182 is removed after pouring, so as to expose an outer face of the concrete foundation extending downwardly from the floor assembly to the site. Also, in most cases, the inner form means 184 will remain in place as it will usually be difficult to extract and does not present problems when left in place.

The method is characterized by supplying the foundation material through the delivery opening 185, i.e. from a pipe, not shown, and permitting the concrete to flow into the foundation space 201, covering the metal strips 192, and filling the space progressively upwardly. As volume of concrete builds up within the space 201, air is displaced from the upper portion of the foundation space through the breather openings 187 so as to reduce void formation in the foundation material. Clearly, as the foundation material is supplied into this space, location of the inner and outer faces of the foundation means is controlled by the inner and outer form means 182 and 184. In this way the foundation material occupies only the foundation space, while leaving an empty innermost space between inner portions of the floor assembly, the site surface, and the inner form means.

As before, when the foundation material has set, the supports 65 are lowered and removed. The outer form means is removed to expose an outer surface of the concrete foundation wall.

It can be seen that the methods described above relating to the two different types of foundation means are generally similar, in that, in both instances, the floor assemblies are located accurately on temporary supports, after which form means are located and foundation material is poured onto the site surface. As the concrete is poured, it moves upwardly to cooperate with a lower surface of the floor assembly and simultaneously accommodates variations in spacing between the site surface and the levelled floor assembly. Clearly, when the foundation material has set, the temporary supports and forms can be removed, leaving the floor assembly accurately located on the foundation material.

Figure 11:
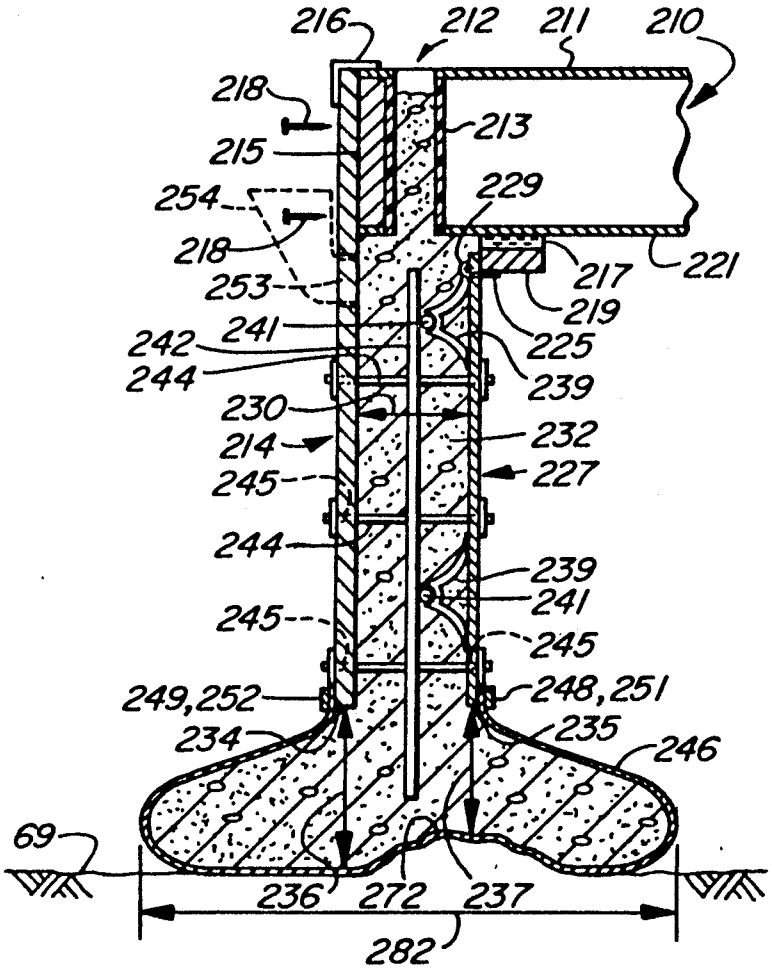
FIG. 11 is a simplified, fragmented section on line 11—11 of FIG. 10, showing the third embodiment prior to removal of form means.
Figure 9:
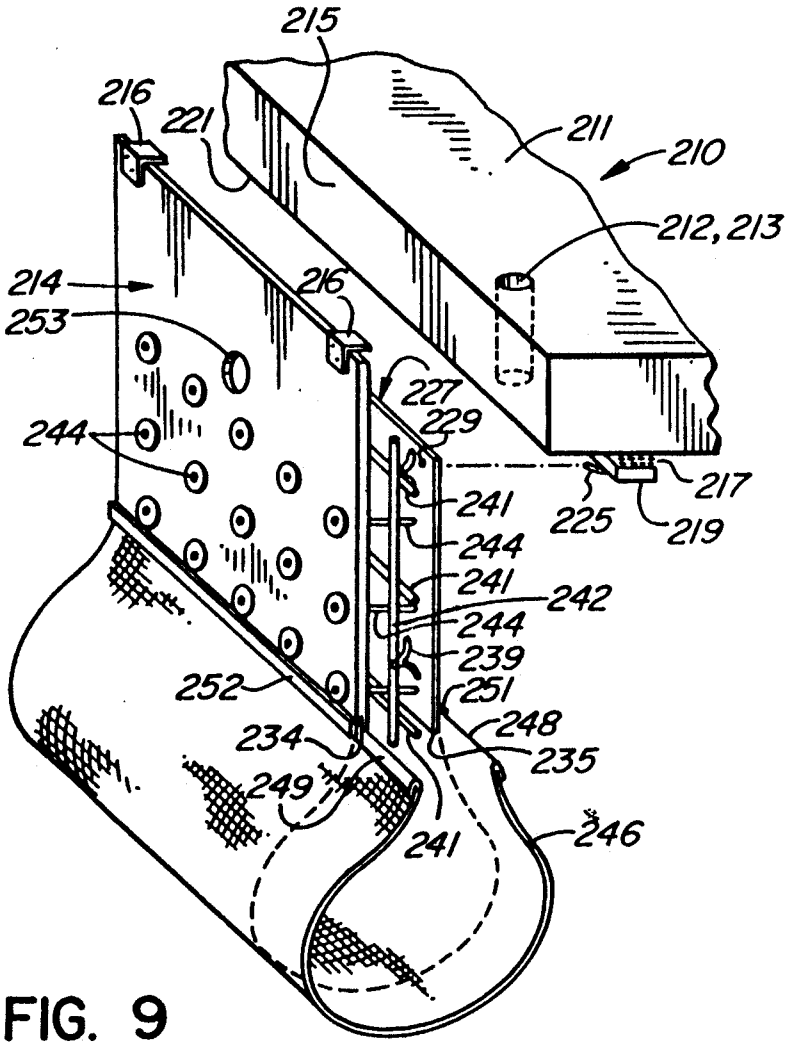
FIG. 9 is a simplified, fragmented isometric view of a third embodiment of foundation form means prior to installation on to a floor assembly, the form means having optional steel reinforcing.
Figure 10:
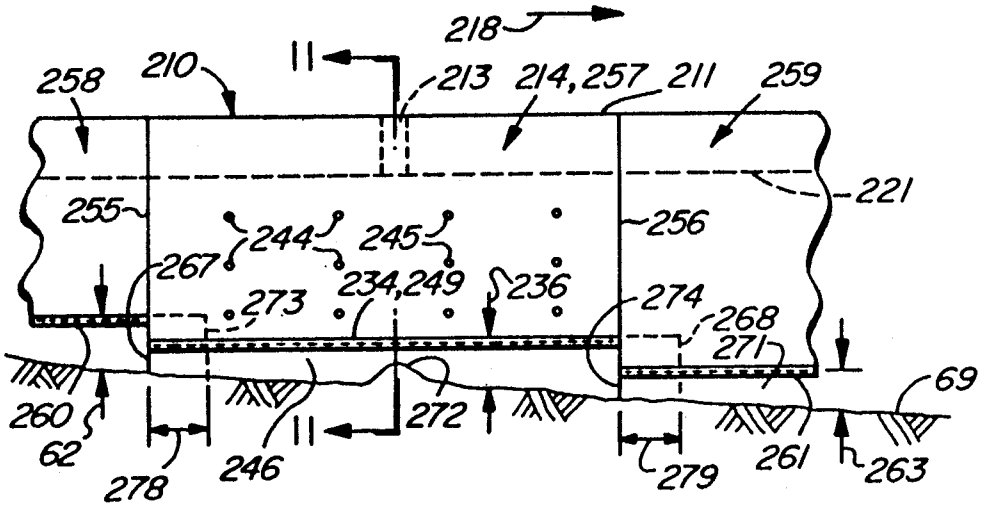
FIG. 10 is a simplified, fragmented side elevation of a portion of the floor assembly and the third embodiment of foundation form means after installation and pouring concrete.
Figure 12:
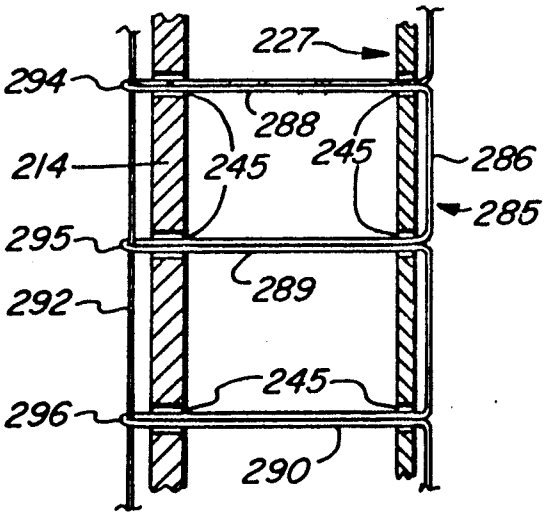
FIG. 12 is a simplified, fragmented section generally similar to FIG. 11 showing an alternative form tie using a flexible link.

FIGS. 9, 10 and 11

Referring mainly to FIGS. 9 and 11, an alternative floor assembly 210 is generally similar to the floor assembly 10 of FIG. 1, but has at least one vertically disposed delivery opening 212 lined with a sleeve 213. Several openings can be spaced around the floor assembly periphery as required. The floor assembly is supported on temporary supports, not shown, as previously described, and a rigid outer form means 214 is temporarily connected by screws 118 to a side edge 215 of the floor assembly to extend vertically downwardly therefrom. A plurality of supporting angles 216 secured to an upper edge of the form means 214 rests on an upper skin 211 of the floor assembly and thus serves as outer form connecting means to support the outer form means while the screws 218 are temporarily secured.

A breather member 217 and a blocking 219 are secured to a lower skin 221 of the assembly 210. The breather member 217 is a strip of longitudinally cored vinyl material, commonly sold in sheet form under the Trade-mark "Coroplast", and manufactured by O & S Plastics Ltd., of Ontario, Canada. This is a lightweight panel that is used for numerous lightweight structural duties in particular for sign boards. In this particular application, the openings are disposed normally to the inner form means 227 and serve to permit air to pass laterally through the member 217 as will be described. A plurality of longitudinally spaced apart hooks 225 extend from the blocking 219 towards the outer form means 214, and are inclined slightly upwardly.

A rigid inner form means 227 has a plurality of openings 229 which are spaced apart along an upper edge of the form means 227 to receive the hooks 215 to support the inner form means along the upper edge thereof. The opening 229 and the hooks 215 thus serve as inner form connecting means. The inner form means is spaced by a spacing 230 from the outer form means to define width of a wall portion 232 of the foundation as will be described. The outer and inner form means 214 and 227 are typically sheets of plywood and have respective lower edge portions 234 and 235 which are spaced from the site surface 69 by respective spacings 236 and 237, which can be typically between about 12 cms and 38 cms (5 and 15 inches). If site conditions dictate, the spacing 236 or 237 could be reduced below 12 cms (5 inches) for a short distance, but this decreases width and depth of the footings and may not be permissible.

A plurality of conventional stirrups 239 are secured to the inner form means 227 to support a plurality of horizontal reinforcing bars 241 and which can also support a plurality of vertical reinforcing bars 242. A plurality of conventional metal form ties 244 are provided in a grid pattern between upper and lower edges of the forms, and between horizontally spaced apart edges of the forms to provide means to control spacing between the inner and outer form means. The inner and outer form means each have a plurality of form tie openings 245 which can be generally aligned to receive the form ties.

A length of flexible fabric form 246 has oppositely located inner and outer side edges 248 and 249 connected to the lower edge portions 235 and 234 respectively of the inner and outer form means. Inner and outer securing straps 251 and 252 are secured along the side edges of the fabric and the lower edge portions 235 and 234 respectively of the form means to maintain a secure connection between the form means and the flexible fabric form. Preferably, the flexible fabric form is a geo-textile material, typically a non-woven synthetic fibre felt, which can pass moisture from concrete as is well known in the trade. The flexible fabric serves as a flexible form means as will be described, and has a width defined by the side edges 248 and 249 which is sufficient to permit the fabric to assume a curved sheet having a general shape as shown in FIG. 11 when filled with concrete, as will be described.

As previously described, concrete is supplied to a foundation space between the inner and outer form means through the delivery opening 212, the concrete passing down the sleeve 213 to fill the foundation space The opening 212 is located in a position which will normally be covered by a wall of building, and thus will not require specific closing after the building is completed. In some applications, delivery openings to cannot be located adjacent the floor periphery as shown, and an optional location can be provided through the outer form means 214, for example through an optional side delivery opening 253 adjacent an upper portion of the outer form means and below the lower skin 221 of the floor assembly. A concrete delivery hose can be inserted through the opening 253, or a "birds-mouth" or funnel 254, shown in broken outline in FIG. 11 can be temporarily inserted in the opening to receive concrete to feed concrete into the foundation space.

To reduce on-site labour, the form assembly of FIG. 9 can be factory assembled and delivered to the site for quick installation onto the floor assembly. The form assembly includes the inner and outer form means 227 and 214, with the flexible form means 246 connected thereto with the securing means 252 and 252, the form connecting means, that is the supporting angles 216 and openings 229, and if reinforcing is required, the bars 241 and 242 in associated stirrups, and the ties 244 passing through the tie openings. Clearly, the forms must be of a convenient size for handling, and typical forms made from plywood sheet of suitable height can be accurately cut to size and prepared with openings and connections as required for a specific building site.

Referring specifically to FIG. 10, the outer form means 214 has oppositely located generally vertical first and second side edges 255 and 256 respectively. The outer form means 214 and the corresponding inner form means 227 are defined as a first rigid form pair 257, and are disposed between similar second and third rigid form pairs 258 and 259 respectively. The form pairs 258 and 259 have corresponding inner and outer rigid form means with similar generally vertical side edges which are butted against the first and second side edges 255 and 256 of the means 214 and corresponding side edges of the means 227 to form a relatively fluid-tight butt joint, through which loss of concrete material is negligible, as is well known in the trade. If, through poor fitting, the edges are separated by an appreciable gap, a suitable sealing strap or filler material can be fitted to reduce loss of concrete through the gap.

The second and third form pairs 258 and 259 have respective lower edge portions 260 and 261 respectively. As seen in FIG. 10, the site surface 69 slopes downwardly from the second panel towards the third panel and the lower edge portions 260, 234 and 261 are disposed as descending steps to reduce excessive variation of the spacing 236, and an equivalent spacing 262 and 263 between the second and third form pairs and the surface 69 respectively. The rigid form pairs 257, 258 and 259 can be conventional plywood panels, typically about 244 cms (8 feet) long and between about 61 cms (2 feet) and 122 cms (4 feet) high, depending on height of the foundation walls to be poured below the floor assembly. If the panels are supplied in increments of about 150 cms (6 inches), for use on a steadily sloping site as shown in FIG. 9, each panel would be that increment higher as the slope descends. In this way, the panels could easily accommodate a slope of about 1 in 16, although steeper slopes could probably be accommodated.

The flexible fabric form 246 has a length defined by first and second end edges 267 and 268, the first edge 267 being generally aligned with the first side edge 255 of the form means, and the second edge 268 being shown in broken outline and extending beyond the second edge 256 of the form means. The second and third form pairs 258 and 259, have corresponding outer and inner rigid form means, connected to similar second and third flexible form means 270 and 271 respectively, which have sufficient widths to accommodate any variation in the spacings 262 and 263 as previously described. The second flexible form means 270 has a second end edge 273 (broken outline) extending beyond the first side edge of the second form means, and the third flexible form means 271 has a first end edge 274 generally aligned the first side edge of the form means.

The second end edge 273 of the second flexible form 270 has a length approximately equal to length of the first end edge 267 of the first flexible fabric form 267, so that the second end edge 273 can pass into an open loop end of the first end edge 267 to provide an adequate overlap 278. Similarly, the lengths of the second end edge 268 of the first form means and the first edge 274 of the third form means 271 are approximately equal so that the second end edge 268 can pass into an open loop end of the first end edge 274 to provide an adequate overlap 279. The overlaps 278 and 279 are not critical, but preferably should be of the order of about 250 cms (10 inches). It can be seen that the end edges of the first flexible form means are locatable to overlap generally complementary end edges of adjacent second and third flexible form means 270 and 271 which are locatable at opposite ends of the first form means so as to provide an adequate seal due to the overlap between the adjacent flexible form means. If necessary, staples or other fasteners can be used to improve sealing at the overlaps.

In operation, the forms are installed in a manner which resembles that of the two previously described embodiments, with differences which increase flexibility of the invention and permit it to be used on sites having less well prepared surfaces. The flexible forms can tolerate a wider variation in surface undulations than the two previously described embodiments and a protruding rock or high spot 272 is shown in FIGS. 10 and 11 being easily accommodated by the flexible fabric as it is filled with concrete. In particular, the third embodiment has an accommodation to site undulations limited mainly by the ability of the flexible form means to maintain a sufficient width of footing without shifting undesirably either inwardly under the floor assembly, or outwardly away from the floor assembly. If the site has steeply sloping bedrock portions which cannot be easily accommodated, it might be necessary to provide additional supports in the form of rocks, etc. to reduce excessive lateral movement of the flexible form means with respect to the foundation.

As previously described, the floor assembly 210 is supported on temporary supports and the requisite number of floor assemblies are connected together to provide an accurately levelled floor assembly. The lower skin 221 can be prepared in the factory with the breather member and blocking 217 and 219 respectively, and the hooks 225 already in place. Thus, the inner form means 227 can be easily hung from the hooks by inserting the hooks 225 into the requisite openings 229. Preferably, if reinforcing is required, the stirrups 239 are already secured to the inner form means, with the horizontal and vertical reinforcing bars 241 and 242 as previously described, thus reducing on-site labour costs. The form ties 244 extend outwardly from the inner form means 227, and are received in the complementary tie openings 245 in the outer form means 214. The supporting angles 216 engage the upper skin of the floor assembly 210 to support the form means 214 before inserting the screws 218. Preferably, the flexible fabric form 246 was also previously connected to the lower edge portions of the inner and outer form means 227 and 214 at the factory, and thus can be approximately adjusted in place on the site surface 69 when installed as above described. Alternatively, the flexible form means and reinforcing bars etc. can be secured in place on the site, although this would tend to produce more errors, and clearly increases on-site labour costs.

The remaining rigid and flexible form means are installed in a similar manner around the complete periphery of the floor assembly, providing the overlap between adjacent flexible form means as described with a reference to FIG. 10. As shown in FIGS. 10 and 11, if a portion at the site contains some immovable object, such as bedrock or large boulder, the invention can accommodate this irregularity as the flexible form means can conform to the upper surface of the irregularity when the concrete is poured.

The concrete is pumped through the delivery openings 212 passing in sequence around the building, preferably starting at a selected position which is initially filled so that the pour of concrete fills the flexible form means to pass somewhat above the lower edges 234 and 235 of the outer and inner rigid form means. The flexible form is filled and bulges as shown in an attempt to attain a stable cross-sectional shape, which is usually two to three times wider than the spacing 230 between the rigid form means. The concrete is pumped into adjacent delivery openings so that a direction of filling of the forms, as shown by an arrow 218, is such that concrete flows across the overlaps of adjacent flexible forms, with little tendency to leak therethrough. Thus concrete moves over the overlaps in an manner similar to water flowing down a tiled roof. The concrete does not attain an excessive height in one pour so as to limit a hydraulic head for the form means. Width 282 of the resulting bulged flexible form means should provide a footing of a minimum width based on structural requirements as is common practice.

When the flexible form means has been filled with concrete, a sufficient delay enables partial curing and the footing is now able to withstand hydraulic pressure of concrete poured into the rigid form means to fill the remaining foundation space defined by the rigid form means, completely up to the lower skin 221 of the floor assembly. In this way, hydraulic pressure on the flexible form means is reduced, because once the concrete in the flexible form means has partially cured, the hydraulic loads on the flexible form means are essentially eliminated. For filling upper portions of the forms, it is not necessary to supply the concrete to the form means working in a specific sequence around the building. Usually, the concrete is fed into each delivery opening 212 to provide a feeder or excess volume of concrete and provide a slight hydraulic head to ensure the rigid forms are filled to the lower skin 221. As before, air within the foundation space is displaced through the breather member 217 as the concrete fills the space. As concrete settles in the wall portion of the form, any loss in volume due to entrapped air or leakage through gaps in the forms can usually be made up by the feeder or small amount of concrete remaining in the sleeve 213.

When the concrete is cured, the outer form means 214 is removed by separating the form ties 244 as is common practice, and unscrewing the screws 218, permitting re-use of the outer form means. The flexible form means fabric 246 can be cut adjacent the lower edge 234, permitting the remainder of the flexible form means to stay in place around the concrete which serves as a footing. The inner form means 227 is usually sacrificed and remains in place.

In summary, the method can be seen to include the following steps. The inner and outer form means are attached sequentially to the floor assembly to extend downwardly therefrom towards the site surface, so that lower edge portions of the form means are spaced above the site surface. As before, the inner form means is located generally adjacent to, but spaced inwardly a final position of the outer form means. The method is further characterized by providing a flexible form means to extend between the lower edge portions of the inner and outer form means to provide a foundation space defined by the inner and outer form means and the flexible form means. The flexible form means is of sufficient size to rest on the surface when contained in the foundation material to provide footings of adequate width when the foundation material has set. Preferably, the inner and outer form means are connected together by the form ties to control spacing therebetween. If reinforcing is required, stirrups are provided on the inner form means so as to be located within the foundation space, and reinforcing bars are connected to the stirrups to locate the bars within the foundation space as is well known. As in the previous inventions, while supplying the foundation material into the foundation space, air is displaced from an upper portion of the foundation space to reduce void formation in the foundation material.

The resulting foundation structure has an upper wall portion and an adjacent lower footing portion. The footing portion is essentially surrounded by a flexible foundation means which extends to a boundary between the wall portion and the footing portion, the footing portion being of a greater transverse width than the wall portion. The boundary is located at the lower edge portions 234 and 235.

FIG. 12

Conventional form ties 244 are time consuming to install and to separate from the forms to permit removal of the outer form means. An alternative thread form tie 285 can be substituted for the conventional form ties as follows. The thread form tie is a first length of cord or wire 286 which passes through the array of the form tie openings 245 in the outer and inner form means 214 and 227 as shown to form a series of spaced apart upper, intermediate and lower loops 288, 289 and 290 extending between the form means. Outer ends 294, 295 and 296 of the loops 288, 289 and 290 respectively are disposed on an outer side of the outer form means 214 remote from the inner form means and receive a second length of cord or wire 292 which passes across the panel to retain outer ends of the loops therein. Lengths of the loops are relatively critical as this controls spacing between the inner and outer form means, and thus cord tension is of prime importance when threading to ensure accurate spacing between adjacent forms.

The first length of cord or wire 286 is sufficiently flexible to permit it to be formed to pass in the series of loops as shown, whereas the second length of cord or wire 292 can be somewhat stiffer as it follows a much straighter path. In any event, the first and second lengths are termed tension links in the claims.

FIGS. 9 through show conventional metal ties, which are relatively time-consuming to install, even in the preferred factory installation setting. Nevertheless, they can be installed prior to delivery on the site, and when so installed, permit the inner and outer form means to be stacked together to reduce storage volume. However, for factory installation of ties, the thread form ties 285 are preferred, as they are more easily adapted to an automated process of threading through the form tie openings to form the loops as described. Furthermore, the inner and outer form means could be more easily stacked with flexible tension links connecting the forms together.

FIG. 13

The third embodiment of the invention also provides a simplified means of providing footings for an interior subwall, equivalent of the subwall 82 of FIG. 2. While the description following refers to an interior subwall, that is a subwall disposed remotely from outer walls of the floor assembly, it could be applied to exterior subwalls, i.e., equivalent to the subwall 54 of FIG. 1.

An interior subwall 300 of the third embodiment of the invention comprises generally parallel and horizontal upper and lower plates 302 and 304, a panel of wall sheathing 306 and a plurality of parallel and vertical studs 308, one only being shown. The floor assembly 210 is carried on the upper plate 302, and the upper and lower skins 211 and 212 have aligned openings to receive a vertically disposed sleeve 310. The upper and lower plates 302 and 304 have similarly aligned openings to receive the sleeve 310, which thus passes from at least the upper skin through to the lower plate 304. The lower plate serves as a sub-wall base, similarly to the plate 86 of FIG. 2.

A flexible form means 312 has oppositely located inner and outer longer side edges 314 and 315 connected with securing means 316 and 317 respectively to opposite sides or lower edge portions of the lower plate 304 so as to form an enclosed foundation space similar to that shown in FIG. 11. The flexible form means is of a sufficient size to rest on the site surface 69 when containing the foundation material to provide footings of adequate width when the foundation material has set.

In operation, the subwall 302 is secured to the lower skin 221 with the openings in the skins receiving the sleeve 310, the sleeve thus acting as a dowel to ensure correct registration and location of the subwall. Concrete is poured through the sleeve 310 to fill the flexible form means 312 which bulges outwardly as shown and provides a footing of suitable width. As before, a short column of concrete remain in the sleeve 310 to act as a feeder to supply concrete to the foundation space as liquid and air is lost through the flexible form means as the concrete cures. Clearly, the subwall 300 and the flexible form means remain in place and no further work is required for removal of forms.

Figure 13:
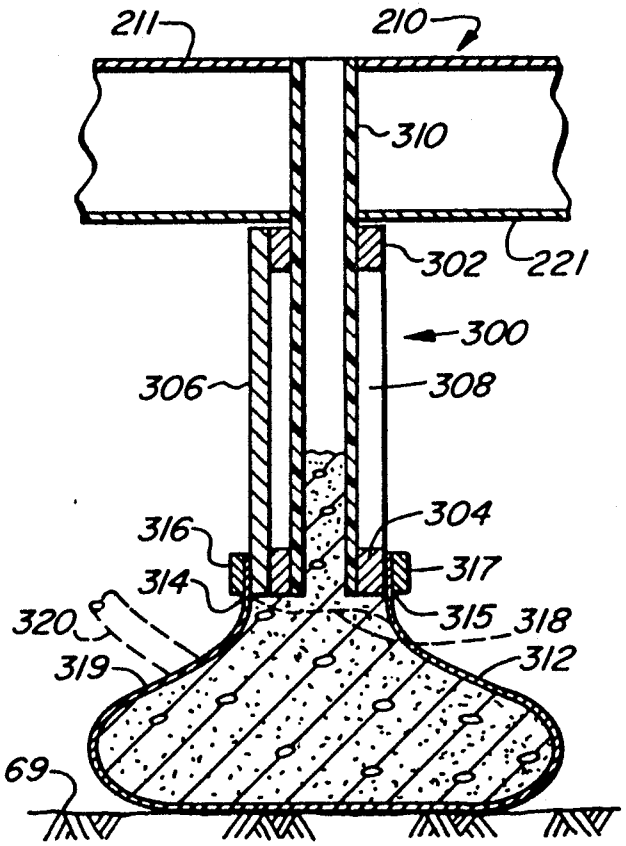
FIG. 13 is a simplified, fragmented section through an interior sidewall showing the third embodiment foundation form means.

It can be seen that the rigid form means 214 and 227 of FIGS. 9 through 11, and the sub-wall 300 of FIG. 13 serve as support means having upper and lower portions, the lower portions having laterally spaced apart lower edge portions, and the upper portions being connectable to the floor assembly. Each support means has a flexible form means having inner and outer side edges connected to the lower edge portions of the support means to form a curved sheet of flexible form means extending therebetween. The flexible form means receives concrete which can accommodate a wide variation in surface levelness, thus reducing site preparation. While the flexible form means 312 of FIG. 13 is shown having two laterally spaced apart side edges 314 and 315 connected to the lower plate 304, the edges could be connected together to form a loop or hollow cylinder of flexible fabric, which is shown in broken outline at 318. The joined edges of fabric are secured along one edge of the lower plate 304, e.g. at 314. Because there is no opening in the fabric form to receive concrete from the sleeve 310, an alternative opening 319 outside the plate 304 can be used to receive a concrete delivery pipe 320, shown in broken outline.

It can be seen that the flexible form means functions generally similarly to conventional form work which is installed on site, but clearly requires far less labour for installation, as well as eliminating many of the problems associated with a conventional form work. In FIGS. 9 through 11, the support means comprises one re-usable form, namely the outer form means, and a sacrificed form, namely the inner form means, whereas in FIG. 13, the support means is a portion of the building and remains in place similarly to the sacrificed form means.

I claim:

1. A method of installing a floor assembly and building foundation on a site surface, the method comprising the steps of:

(a) placing a plurality of supports on the surface, (b) placing a floor assembly on the supports to provide a space between the floor assembly and the surface, (c) connecting an exterior sub-wall along at least some peripheral portions of the floor assembly to extend downwardly therefrom to form an exterior foundation wall of the building, the sub-wall having a sub-wall base spaced above the surface, (d) locating form means on the surface and below some of the peripheral portions of the floor assembly, the form means being located on either side of the sub-wall base and clear of the supports.

(e) supplying a flowable and settable foundation material to occupy at least a portion of a space defined in part by the form means, the sub-wall base and the surface so as to be located below the peripheral portions of the floor assembly, so that when the foundation material has set, the floor assembly is also supported by the sub-wall base onthe foundation material.

2. A method as claimed in claim 1, further characterized by:

(a) connecting a portion of the form means to the sub-wall to control location of said portion of the form means.

3. A method as claimed in claim 1, further characterized by:

(a) connecting an interior sub-wall at a position remote from the peripheral portions of the floor assembly to provide an interior foundation wall of the floor assembly, (b) locating an interior form means on the surface and on either side of the interior foundation wall.

4. A method as claimed in claim 1, further including:

(a) placing a plurality of floor assemblies on the supports to provide respective spaces between the floor assemblies and the surface, (b) interconnecting adjacent floor assemblies together along adjacent joining portions thereof to form an assembled floor of a building, (c) locating the form means to surround an overall periphery of the assembled floor, so that when the foundation material is set, the assembled floor is supported along the overcall periphery thereof.

5. A method as claimed in claim 4, further characterized by:

(a) connecting a plurality of sub-walls to respective floor assemblies to extend downwardly from outer peripheral portions of respective floor assemblies, the sub-walls having sub-wall bases spaced above the surface, (b) locating a plurality of form means on the surface to straddle respective subwalls and to be clear of the supports, (c) supplying the foundation material to occupy portions of the spaces between the sub-wall bases, the form means and the surface, (d) removing the supports after the foundation material has set.

6. A method as claimed in claim 1 in which:

(a) locating the form means includes attaching an outer form means to the peripheral portions of the floor assembly to extend downwardly therefrom towards the surface.

7. A method as claimed in claim 6, in which:

(a) locating the form means includes securing an inner form means to the floor assembly to extend between the floor assembly and the surface, the inner form means being disposed generally adjacent to, but spaced inwardly of, the outer form means, so as to provide a foundation space defined by the inner and outer form means and adjacent oppositely facing portions of the floor assembly and the surface, (b) and when supplying the foundation material, controlling the location of outer and inner faces of the foundation material by the outer and inner form means so that the foundation material occupies only the foundation space, while leaving an essentially empty innermost space between the floor assembly, the surface and the inner form means, (c) removing the supports after the foundation material has set.

8. A method as claimed in claim 7, further characterized by:

(a) securing the outer form means with fastening means to the adjacent periphery of the floor assembly, (b) providing breather openings adjacent upper portions of at least some of the form means to permit air to be displaced from the foundation space.

9. A method as claimed in claim 7, further characterized by:

(a) securing the inner form means with fastening means to positions disposed inwardly of the adjacent periphery of the floor assembly, and inwardly of the outer form means by a space to provide a finished foundation of sufficient width to contact and support the floor assembly, (b) providing breather openings adjacent upper portions of at least some of the form means to permit air to be displaced from the foundation space.

10. A method as claim in claim 1, further including:

(a) providing a flexible form means to extend from the sub-wall base, (b) supplying the foundation material to occupy space between the sub-wall base, the flexible form means and the surface, to provide a footing when the foundation material has set.

11. A method as claimed in claim 7, further characterized by:

(a) while supplying the foundation material to the foundation space, permitting air to be displaced from upper portions of the foundation space to reduce void formation in the foundation material.

12. A method as claimed in claim 1, further characterized by:

(a) removing the supports after the foundation material has set.

13. A method as claimed in claim 4, further characterized by:

(a) providing the plurality of floor assemblies with portions of service conduits extending therethrough, (b) placing the plurality of floor assemblies on the supports so as to be adjacent each other so that ends of the portions of service conduits are adjacent each other, (c) interconnecting adjacent floor assemblies together along adjacent connecting portions thereof to form an assembled floor of a building, (d) interconnecting the ends of adjacent service conduits together to provide an interconnected service conduit extending through the assembled floor.

14. A pre-fabricated floor assembly and foundation installation for a building comprising:

(a) a first floor assembly having a first upper skin and a first lower skin, outer webs and trim webs connecting the skins together adjacent peripheries of the skins to form a plenum chamber between the skins and the webs, (b) foundation material located on a site surface and closely conforming to a lower portion of the floor assembly to support the floor assembly above the surface and to resist lateral forces on the floor assembly, (c) thermal insulation cooperating with the lower skin to assist in insulating the plenum chamber.

15. An assembly as claimed in claim 14, further including:

(a) at least one web having an opening, (b) a service conduit located between the skins and passing through the opening in the web, the conduit having an end located adjacent a portion of the periphery of the floor assembly.

16. An assembly as claimed in claim 14, further including:

(a) a plurality of inner webs extending between the periphery of the assembly to divide the plenum chamber into plenum chamber portions, (b) the inner webs having openings to interconnect the plenum chamber portions.

17. An assembly as claimed in claim 16, in which:

(a) a service conduit extends through at least some of the openings in the inner webs.

18. An assembly as claimed in claim 14, further including:

(a) the lower portion of the assembly includes a sub-wall extending downwardly from the floor assembly, the sub-wall having a sub-wall base spaced above the surface (b) the foundation material closely conforming to the sub-wall base so as to support the floor assembly thereon and to resist lateral forces on the floor assembly.

19. An assembly as claimed in claim 18, in which:

(a) the sub-wall extends along a portion of a periphery of the floor assembly to form an outer foundation wall of the building.

20. An assembly as claimed in claim 18, in which:

(a) the sub-wall is located at a position remote from a periphery of the floor assembly to provide an interior foundation wall of the building.

21. An assembly as claimed in claim 14, further including:

(a) a second floor assembly having a second upper skin and a second lower skin, outer webs and trim webs interconnecting the second skins together adjacent peripheries of the skins to form a plenum chamber between the skins and the webs, the second floor assembly having a joining portion, (b) the first floor assembly having a joining portion generally complementary to the joining portion of the second floor assembly.

22. An assembly as claimed in claim 21, in which:

(a) the joining portion of the first floor assembly has a projection with upper and lower male surfaces extending outwardly of the first upper and lower skins respectively with respect to the joining portion, the upper male surface being spaced below an upper surface of the first upper skin by an upper spacing, and the lower male surface being spaced above a lower surface of the first lower skin by a lower spacing, (b) the joining portion of the second floor assembly having a recess to receive the projection of the first floor assembly, the recess being defined in part by an upper female surface spaced below an upper surface of the second upper skin by the said upper spacing, and a lower female surface being spaced above a lower surface of the second lower skin by the said lower spacing, (c) fastener means passing through at least a portion of the upper skin of the second assembly to connect to the projection of the first floor assembly.

23. An assembly as claimed in claim 22, in which:

(a) the joining portion of the first skin has a I-beam shaped outer web, the I-beam having upper and lower horizontal flanges interconnected by a vertical web, an upper surface of the upper flange providing the upper male surface, and a lower surface of the lower flange providing the lower male surface.

24. An assembly as claimed in claim 14, in which:

(a) an upper surface of the upper skin bears layout markings to indicate future positions of at least walls of the building.

25. An assembly as claimed in claim 14, in which:

(a) the foundation material has an upper wall portion and an adjacent lower footing portion, the footing portion being essentially surrounded by a flexible foundation means which extends to a boundary between the wall portion and the footing portion, the footing portion being of a greater transverse width than the wall portion.

26. A floor assembly as claimed in claim 14 in which:

a) the peripheries of the skins define a corresponding periphery of the floor assembly, b) at least one portion of the periphery of the floor assembly has an inner form connecting means spaced inwardly from the adjacent periphery.

27. A floor assembly as claimed in claim 26 in which:

a) the form connecting means for the inner form means has a breather means to permit air to pass outwardly from the form means where concrete is supplied to the form means.

28. A floor assembly as claimed in claim 26 in which:

a) the upper and lower skins have aligned delivery openings located between the periphery of the floor assembly and the form connecting means.

29. A floor assembly comprising:

(a) upper and lower skins, each skin having a respective periphery, (b) outer webs and trim webs connecting the skins together adjacent the peripheries of the skins to form a plenum chamber between the skins and the webs, (c) thermal insulation cooperating with the lower skin.

30. A floor assembly as claimed in claim 29, further including:

(a) at least one web having an opening, (b) a service conduit located between the skins and having an end located adjacent a portion of the periphery of the floor assembly.

31. A floor assembly as claimed in claim 29, further including:

(a) a plurality of inner webs extending between the periphery of the assembly to divide the plenum chamber into plenum chamber portions, (b) the inner webs having openings to interconnect the plenum chamber portions.

32. A floor assembly as claimed in claim 31, in which:

(a) a service conduit extends through at least some of the openings in the inner webs.

33. A floor assembly as claimed in claim 29, further including:

(a) the lower portion of the assembly includes a sub-wall having a sub-wall base, the sub-wall being extendable along and downwardly from a periphery of the floor assembly to form an outer foundation wall of the building.

34. A floor assembly as claimed in claim 29, in which:

(a) at least a portion of the periphery of the assembly has a joining portion, the joining portion having at least one surface adapted to cooperate with a complementary surface of a joining portion of an adjacent skin.

35. A floor assembly as claimed in claim 29, in which:

(a) an upper surface of the upper skin bears layout markings to indicate future positions of at least walls of the building.

36. A building foundation apparatus comprising:

a) a support means having upper and lower portions, the lower portion having laterally spaced apart lower edge portions, the upper portion being connectable to a floor assembly, b) a flexible form means connected to the lower portion of the support means to form a curved sheet of flexible form means extending therebetween and being adapted to receive and hold a flowable and settable foundation material.

37. An apparatus as claimed in claim 36 in which:

a) the support means includes inner and outer rigid form means, and the upper and lower portions thereof comprise each form means having upper and lower edge portions respectively, b) the flexible form means has inner and outer side edges connected to the lower edge portions of the inner and outer rigid form means respectively to form the curved sheet of flexible form means extending therebetween, c) form tie means extend between the inner and outer rigid form means to limit spacing between the form means when installed.

38. An apparatus as claimed in claim 37, in which:

a) the inner and outer rigid forms have an array of form tie openings, b) the form tie means extend between the respective form tie openings.

39. An apparatus as claimed in claim 38 in which the form tie means include:

a) a first length of tension link which passes through the array of form tie openings in the outer and inner form means in sequence to form a series of spaced apart loops extending between the form means, outer ends of the loops being disposed on an outer side of the outer form means remote from the inner form means, b) a second length of tension link which passes across the outer side of the outer form means and is received in outer ends of the loops of the first thread form tie to retain the outer ends of the loops.

40. An apparatus as claimed in claim 37 further comprising:

a) form connecting means disposed along upper edge portions of the inner and outer rigid form means, the connecting means being connectable to the floor assembly for installation.

41. An apparatus as claimed in claim 38 in which:

a) the connecting means for the outer form means is an angle member extending from the outer form means towards the inner form means, b) the connecting means of the inner form means is a plurality of openings to receive connecting members.

42. An apparatus as claimed in claim 36 in which:

a) the support means includes a sub-wall, and the upper and lower portions of the support means comprise generally parallel upper and lower plates, the lower plate forming a sub-wall base and having the spaced apart lower edge portions.

43. An apparatus as claimed in claim 42 in which:

a) the upper and lower plates are connected by a panel, and the plates have generally aligned openings, b) a delivery tube passes between the generally aligned openings and has an upper end projecting from the upper plate, and a lower end communicating with the space between the side edges of the flexible form means.

44. A method of installing a floor assembly and building foundation on a site surface, the method comprising the steps of:

(a) placing a plurality of supports on the surface, (b) placing a floor assembly on the supports to provide a space between the floor assembly and the surface, (c) attaching at least one rigid form means adjacent at least some peripheral portions of the floor assembly to extend downwardly therefrom towards the site surface, the rigid form means having a lower edge portion spaced above the site surface, (d) providing a flexible form means to extend between the lower edge portion of the rigid form means and a connection means cooperating with the floor assembly to provide a foundation space defined by the said at least one rigid form means and the flexible form means, the flexible form means being of sufficient size to rest on the site surface when containing a flowable and settable foundation material to provide footings of adequate width when the foundation material has set, (e) supplying the foundation material to occupy the foundation space defined in part by the rigid and flexible form means, and to be located below the peripheral portions of the floor assembly, so that when the foundation material has set, the floor assembly is supported on the foundation material.

45. A method as claimed in claim 44 further comprising:
(a) restraining lateral displacement of the flexible form means relative to the rigid form means by providing generally laterally extending connections between the rigid form means and the flexible form means.

46. A method as claimed in claim 44 further comprising:
(a) attaching the said at least one rigid form means to a position adjacent outer peripheral portions of the floor assembly to form an outer rigid form means,
(b) attaching an inner rigid form means to the floor assembly at a position spaced inwardly from the outer rigid form means to provide the said connection means cooperating with the floor assembly and the flexible form means,
so that the flexible form means is attached to lower edge portions of the outer and inner rigid form means.

47. A method as claimed in claim 46, further comprising:
(a) connecting the inner and outer form means together with form ties to control spacing therebetween.

48. A method as claimed in claim 47, further comprising:
(a) providing stirrups on the inner form means so as to be located within the foundation space when installed,
(b) connecting reinforcing bars to the stirrups to locate the bars within the foundation space, and
(c) connecting the outer form means to the floor assembly.

49. A method as claimed in claim 48, in which:
(a) the flexible form means is a first length of flexible fabric which has two oppositely located inner and outer side edges connected to lower edge portions of the inner and outer form means respectively, and oppositely located end edges at opposite ends thereof, the end edges being locatable to overlap with generally complementary end edges of adjacent second and third flexible form means which are locatable at opposite ends of the first form means so as to provide an adequate seal between adjacent flexible form means.

50. A method as claimed in claim 47 in which connecting the inner and outer form means together includes:
(a) passing a first tension link through an array of openings in the inner form means and the outer form means to form a series of spaced apart loops extending from the inner form means to the outer form means, each loop having an outer end disposed on a side of the outer form means remote from the inner form means,
(b) receiving a second length of tension link through the outer ends of the series of loops to retain the outer ends to control spacing of the form means.

51. A method as claimed in claim 44, further characterized by:
(a) while supplying the foundation material to the foundation space, permitting air to be displaced from upper portions of the foundation space to reduce void formation in the foundation material.

52. A method as claimed in claim 44, further characterized by:
(a) after essentially filling the flexible form material with foundation material, permitting the foundation material to at least partially cure sufficiently to provide a footing which can resist hydraulic pressure from an upper portion of the foundation material,
(b) when the footing portion has partially cured, supplying foundation material to fill a remaining portion of the foundation space, and simultaneously permitting air to be displaced from upper portions of the foundation space to reduce void formation in the foundation material.

53. A method as claimed in claim 46 further characterized by:
(a) attaching the flexible form means to the inner and outer rigid form means prior to connection of the rigid form means to the floor assembly.

54. A method as claimed in claim 46 further characterized by:
(a) while supplying the foundation material to the foundation space, permitting air to be displaced from upper portions of the foundation space to reduce void formation in the foundation material.

55. A method as claimed in claim 44, further characterized by:
(a) removing the supports after the foundation material has set.

56. A method of installing a floor assembly and building foundation on a site surface, the method comprising the steps of:
(a) placing a plurality of supports on the surface,
(b) placing a plurality of floor assemblies on the supports to provide respective spaces between the respective floor assemblies and the surface,
(c) interconnecting adjacent floor assemblies together along adjacent joining portions thereof to form an assembled floor having an overall periphery,
(d) locating form means to surround the overall periphery of the assembled floor, the form means being located below peripheral portions of the assembled floor,
(e) supplying a flowable and settable foundation material to occupy at least a portion of the spaces defined in part by the form means and the surface and to be located below the peripheral portions of the assembled floor, so that when the foundation material has set, the assembled floor is supported along at least the overall peripheral portions thereof.

57. A method as claimed in claim 56 further characterized by:
(a) providing the plurality of floor assemblies with portions of service conduits extending therethrough,
(b) placing the plurality of floor assemblies on the supports so that ends of the portions of service conduits in adjacent floor assemblies are adjacent each other, and
(c) interconnecting the ends of adjacent service conduits together to provide an interconnected service conduit extending through the assembled floor.

58. A method of installing a floor assembly and building foundation on a site surface, the method comprising the steps of:
(a) placing a plurality of supports on the surface,
(b) placing a floor assembly on the supports to provide a space between the floor assembly and the surface,
(c) locating form means below some peripheral portions of the floor assembly by attaching an outer form means to the peripheral portions of the floor assembly to extend downwardly therefrom towards the surface, (d) supplying a flowable and settable foundation material to occupy at least a portion of a space defined in part by the form means and the surface, and to be located below the peripheral portions of the floor assembly, so that when the foundation material has set, the floor assembly is supported onthe foundation material.

59. A method as claimed in claim 58 in which:

(a) locating the form means includes securing an inner form means to the floor assembly to extend between a floor assembly and the surface, the inner form means being disposed generally adjacent to, but spaced inwardly of, the outer form means, so as to provide a foundation space defined by the inner and outer form means and adjacent oppositely facing portions of the floor assembly and the surface, (b) and when supplying the foundation material, controlling the location of outer and inner faces of the foundation material by the outer and inner form means so that the foundation material occupies only the foundation space, while leaving an essentially empty innermost space between the floor assembly, the surface and the inner form means, (c) removing the supports after the foundation material has set.

* * * * *